US007645218B2

(12) United States Patent
Potok

(10) Patent No.: US 7,645,218 B2
(45) Date of Patent: Jan. 12, 2010

(54) EXERCISE APPARATUS FOR PERFORMING A BENT-ELBOW PLANK POSITION PUSH-UP AND METHOD OF USING SAME

(76) Inventor: Paul S. Potok, 45 Emlyn La., Mechanicsburg, PA (US) 17055

( * ) Notice: Subject to any disclaimer, the term of this patent is extended or adjusted under 35 U.S.C. 154(b) by 0 days.

(21) Appl. No.: 12/473,670

(22) Filed: May 28, 2009

(65) Prior Publication Data

US 2009/0298657 A1 Dec. 3, 2009

Related U.S. Application Data

(60) Provisional application No. 61/130,647, filed on May 31, 2008, provisional application No. 61/166,515, filed on Apr. 3, 2009.

(51) Int. Cl.
*A63B 26/00* (2006.01)

(52) U.S. Cl. ..... 482/141; 482/139

(58) Field of Classification Search ..... 482/135, 482/141, 146, 95–96, 101, 907, 132, 139, 482/51, 130

See application file for complete search history.

(56) References Cited

U.S. PATENT DOCUMENTS

| | | | | | |
|---|---|---|---|---|---|
| 1,982,834 | A | * | 12/1934 | Smith | 446/93 |
| 2,408,597 | A | | 10/1946 | Belling | |
| 3,547,434 | A | * | 12/1970 | Ossenkop | 482/71 |
| 3,589,720 | A | * | 6/1971 | Agamian | 482/114 |
| 4,111,417 | A | * | 9/1978 | Gardner | 482/128 |
| 4,340,214 | A | * | 7/1982 | Schutzer | 482/51 |
| 4,506,884 | A | * | 3/1985 | Hankin | 482/131 |
| 4,669,723 | A | * | 6/1987 | Arsenian | 482/71 |
| 4,743,014 | A | * | 5/1988 | Loane | 482/71 |
| 5,147,266 | A | * | 9/1992 | Ricard | 482/131 |
| D335,512 | S | * | 5/1993 | Gvoich | D21/662 |
| 5,222,928 | A | * | 6/1993 | Yacullo | 482/71 |
| 5,328,427 | A | * | 7/1994 | Sleamaker | 482/71 |
| 5,518,483 | A | * | 5/1996 | Oswald | 482/131 |
| 5,643,162 | A | * | 7/1997 | Landers et al. | 482/131 |
| 5,735,778 | A | * | 4/1998 | Piaget | 482/114 |
| 5,749,811 | A | * | 5/1998 | Wilson | 482/71 |
| 5,873,591 | A | * | 2/1999 | Keller | 280/304.1 |
| 6,186,930 | B1 | * | 2/2001 | Ignaczak | 482/141 |

(Continued)

FOREIGN PATENT DOCUMENTS

| | | | |
|---|---|---|---|
| GB | 2274999 | A * | 8/1994 |

*Primary Examiner*—Lori Baker
(74) *Attorney, Agent, or Firm*—Saul Ewing LLP; Kurt L. Ehresman; Theodore R. West

(57) ABSTRACT

An exercise apparatus for performing an armless push-up allows a user to engage in gravity-driven, resistance exercise with improved pectoral isolation and range of motion as compared to known push-up devices. The exercise motion is performed using a yoga-inspired, bent-elbow plank position by a prone (face-down) user. The user places each forearm on a trolley mounted at the top of opposed rails that are inclined toward an elevated centerline. As the trolleys move down the opposed inclined rails, the user's chest descends down; and as the user pinches his elbows together using the pectoralis muscles, the trolleys move up the inclined rails again. Gravity imparts a centered user balance, and the resistance can be varied, such as by changing the incline of the rail assemblies, changing the weight associated with the user, or by adding resistance to the trolley movement.

4 Claims, 11 Drawing Sheets

U.S. PATENT DOCUMENTS 6,280,366 B1 * 8/2001 Hsieh ..... 482/130
6,368,253 B1 * 4/2002 Harrigan ..... 482/70
6,368,254 B1 * 4/2002 Wall ..... 482/71
6,514,180 B1 * 2/2003 Rawls ..... 482/70
6,786,850 B2 * 9/2004 Nizamuddin ..... 482/51
D512,111 S * 11/2005 Summers ..... D21/668
7,090,621 B2 * 8/2006 Loane ..... 482/71
7,108,643 B2 * 9/2006 Wilson et al. ..... 482/141
7,115,073 B2 * 10/2006 Nizamuddin ..... 482/51
7,125,367 B1 * 10/2006 Stearns ..... 482/141
7,134,987 B2 * 11/2006 Goldstein ..... 482/141
D550,312 S * 9/2007 Summers ..... D21/668
7,294,100 B2 * 11/2007 Bull ..... 482/51
7,402,126 B2 * 7/2008 Chang ..... 482/52
7,419,459 B2 * 9/2008 Van Straaten ..... 482/70
7,438,673 B1 * 10/2008 Jones ..... 482/71
D589,573 S * 3/2009 McVay et al. ..... D21/668
7,556,592 B2 * 7/2009 Nizam ..... 482/70
2004/0053752 A1 * 3/2004 Yang ..... 482/70
2004/0242381 A1 * 12/2004 Parmater ..... 482/71
2007/0117693 A1 * 5/2007 Ilioi ..... 482/121
2008/0058167 A1 * 3/2008 Schippers ..... 482/51
2008/0090708 A1 * 4/2008 Balaker et al. ..... 482/138
2009/0176631 A1 * 7/2009 Blessing ..... 482/71

* cited by examiner

EXERCISE APPARATUS FOR PERFORMING A BENT-ELBOW PLANK POSITION PUSH-UP AND METHOD OF USING SAME

CROSS-REFERENCE TO RELATED APPLICATIONS

This application relates to, has subject matter in common with, and claims priority of U.S. Provisional Patent Application Nos. 61/130,647 (filed May 31, 2008) and 61/166,515 (filed Apr. 3, 2009), the contents of which applications are incorporated herein by reference.

FIELD

This application describes an apparatus for performing a modified push-up exercise and methods of use thereof.

BACKGROUND

Resistance exercise is any exercise where muscles contract against an external resistance, the objective being to increase strength, tone, mass, or muscular endurance. Lifting weights using dumbbells or weight machines is an example of resistance exercise. Resistance can also come from elastic tubing or bands, cinder blocks, one's own body weight (for example, as with conventional push-ups), or any other object that forces one's muscles to contract. Broadly speaking, exercise involving resistance training develops the strength and endurance of large muscle groups.

Conventional push-ups are a time-honored and effective exercise predominantly used to develop upper body strength. They are considered a body weight exercise because it is one's own body weight that provides the resistance. Body weight exercises such as push-ups require the individual to stabilize and balance the weight in order to lift the body. This need for balance requires that numerous muscle groups be incorporated, and therefore push-ups and other body weight exercises provide strengthening beyond just those muscles primarily involved in actually displacing the body weight.

The muscles predominantly involved in traditional push-ups are the arms (particularly the triceps), the shoulders (particularly anterior deltoids) and the chest (pectoralis major and pectoralis minor). Although the chest muscles are one of the primary groups of muscles exercised and strengthened by performing push-ups, the effectiveness of push-ups for strengthening the pectoralis muscles is limited. The arms (triceps) are smaller muscles that move through a larger range of motion during a push-up, and therefore fatigue more quickly. This is a critical limiting factor in the duration and intensity of exercise that the chest muscles endure. Often, the fatigued arm muscles reach the point of failure before the pectoralis muscles, and at this point the push-up exercise is no longer effective.

Typically, pectoralis muscle strengthening and development is achieved through weight-lifting. This frequently requires expensive equipment to isolate and maximize the benefit. Unfortunately the "anytime, anywhere" usefulness of body weight exercise is lost. Bench press, chest butterfly, and cross-over pulls are common weight-lifting exercises that target the pectoralis muscles. To some extent, these exercises (particularly bench press) require significant muscle input from the arms, and therefore suffer from the same fatigue-limiting effect seen with standard push-ups. To overcome this, so-called pec decks were created. To a significant extent, these machines isolate their resistance effects to the chest and overcome the limitation for pectoral exertion associated with arm fatigue. These machines are effective for chest development but are commonly large, heavy, not portable, and expensive.

There are some devices available to enhance the effectiveness and comfort of traditional push-ups; however, a continuing and unmet need exists for new and improved exercise equipment that addresses the foregoing arm-fatigue limitations.

SUMMARY

The apparatus and methods provided herein permit the same high degree of pectoral isolation and range of motion afforded by pec decks, while being superior to traditional push-ups. The apparatus and methods provide a novel prone (face-down), yoga-inspired, bent-elbow plank position and range of exercise motion. The apparatus and methods employ body weight for resistance and unique slidable trolleys mounted on opposed rail assemblies or tracks inclined toward an apical midpoint (or elevated centerline) for enhanced user balance. The apparatus includes several inexpensive, durable, and portable elements and embodiments.

In an exemplary method of performing the exercise, a prone user's upper body weight is supported on the forearms, with the user's elbows flexed to about 90° (referred herein to also as the "bent-elbow plank position"), thereby reducing the arm muscle (triceps, biceps, forearms) work needed to perform a traditional push-up and other prone exercises. In operation, the user places each forearm on a trolley mounted at the top of opposed rail assemblies that are inclined toward an elevated midpoint. As the trolleys move down the opposed inclined rail assemblies, the user's chest descends; and as the user pinches his elbows together using the pectoralis muscles, the trolleys move up the inclined rail assemblies again. Gravity imparts a centered user balance, and the resistance can be varied, such as by changing the incline of the rail assemblies, changing the weight associated with the user and placed over the apparatus (such as chest weights), or by adding resistance to the trolley movement.

The exercise apparatus includes two opposed trolleys that move laterally up opposed inclines towards a common apex at the center of the exercise apparatus. The trolleys move from the bottom of each incline towards the apex as a user pinches his elbows together by contracting his pectoralis major muscles to bring his forearms together in front of the user's chest. The trolleys then move laterally away from one another down the inclined surface as the user's muscles relax and the user's body is lowered directly and in balance. This motion uses almost no arm/triceps work, and reduces deltoid work, while at the same time maximally targeting the pectoral muscles. In addition to the bent-elbow plank position, the device can also be used with the arms at least partially extended. This requires some static muscle loading of the upper extremities, but is far less fatiguing to the arms than standard push-ups. The usefulness of performing exercise on this device with the arms extended is that this position reduces the mechanical advantage of the chest muscles and therefore requires much more work from the chest to displace the same body weight as the previously described bent-elbow plank position exercise, especially when the elbows are bent at less than about 90°.

Additional features may be understood by referring to the accompanying drawings, which should be read in conjunction with the following detailed description and examples.

DESCRIPTION OF THE DRAWINGS

The exercise apparatus and its exemplary embodiments and associated methods of use are more clearly understood and readily practiced by reference to the detailed disclosure hereinbelow in conjunction with the following figures, wherein like reference characters designate the same or similar elements, and which figures are incorporated into and constitute a part of this specification.

DETAILED DESCRIPTION

Figure 1:
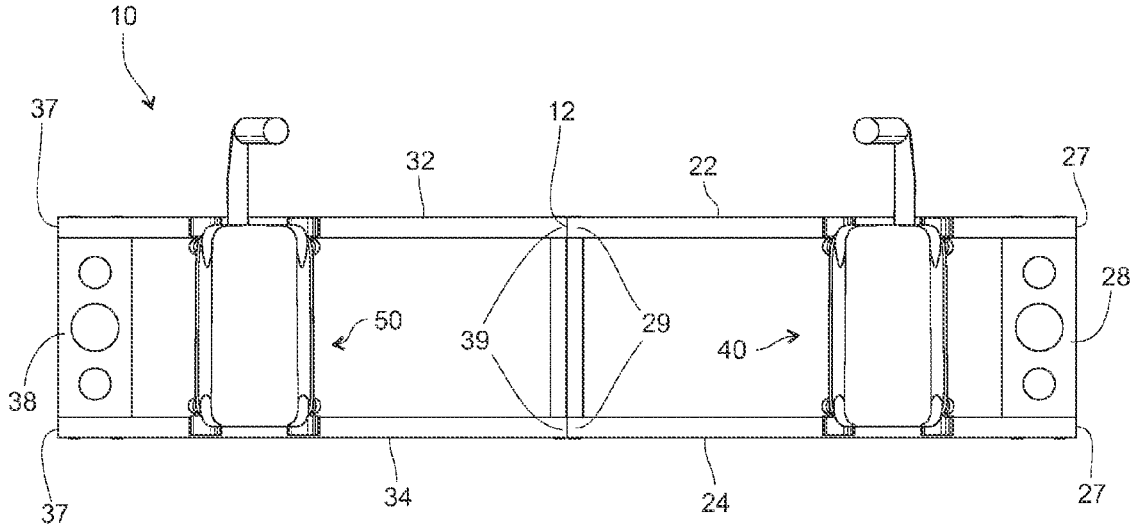
FIG. 1 is a top view of an exercise apparatus according to an exemplary embodiment hereof.
Figure 2:
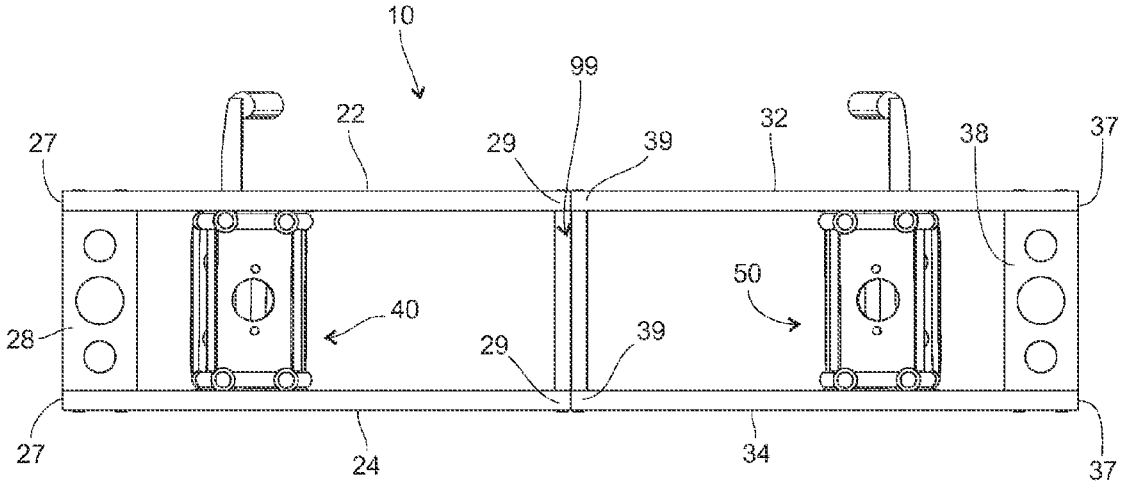
FIG. 2 is a bottom plan view of the apparatus shown in FIG. 1.
Figure 3:
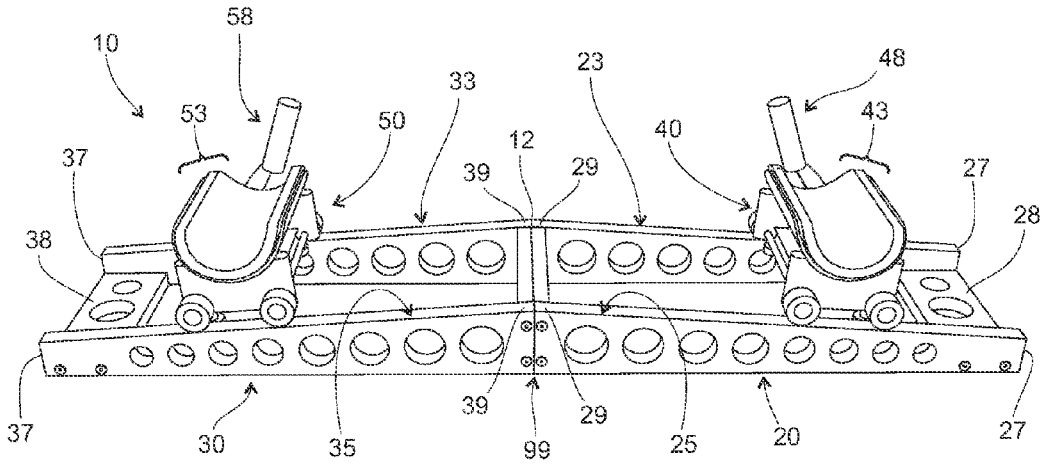
FIG. 3 is a rear elevation view of the apparatus shown in FIGS. 1 and 2.
Figure 4:
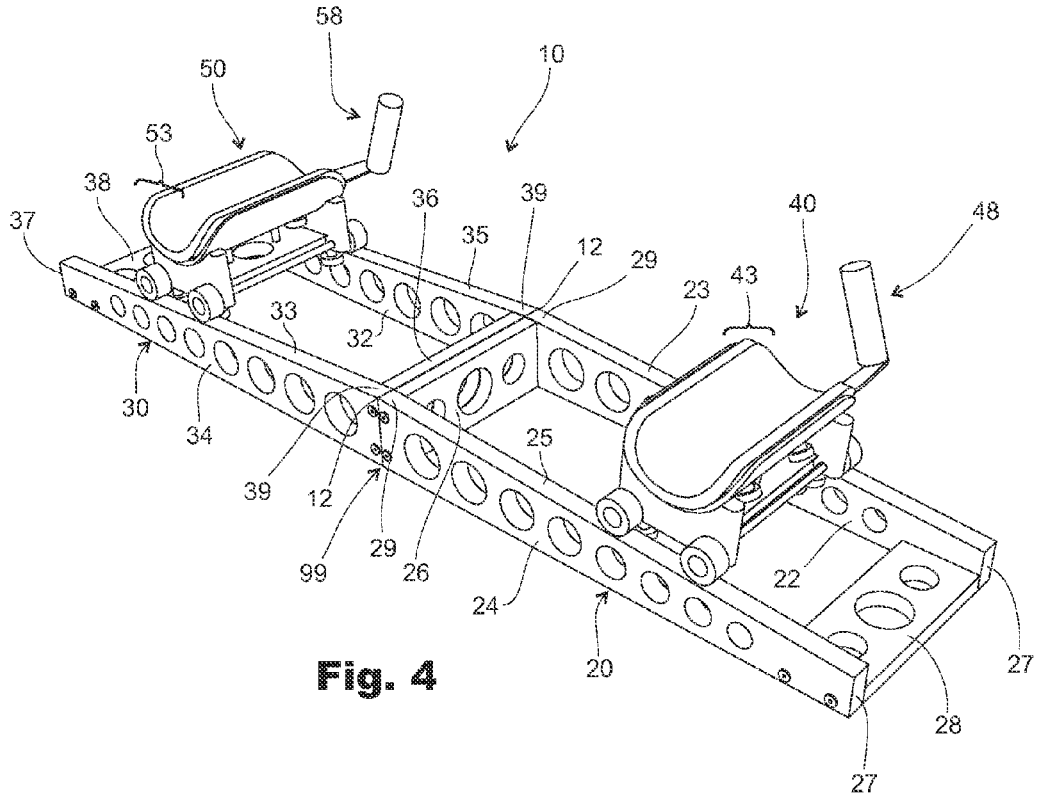
FIG. 4 is a perspective view of the apparatus shown in FIGS. 1-3.

This disclosure describes a new exercise apparatus for performing an armless push-up and related methods for engaging in resistance exercise and strength training. In an exemplary embodiment illustrated in the drawings, exercise apparatus 10 for performing an armless (i.e., bent-elbow plank position) push-up includes two upwardly inclined linear rail assemblies 20, 30 meeting at apical midpoint 12 and two moveable trolleys 40, 50, wherein each rail assembly is engaged with a moveable trolley, each trolley is independently operable (e.g., their movements are not coordinated by a reciprocating pulley system or similar linkage), and the trolleys comprise armrest members 43, 53 anatomically compatible with (i.e., sized and configured to engage with) a forearm of a human user.

The rail assemblies each may include a set of two or more co-planar linear rail members. Alternatively, each rail assembly may be a monorail having one linear rail member. The rail assemblies are preferably symmetrical, disposed 180° from each other, and of sufficient total length to comfortably accommodate the arm span of a human operator, for example, between about 1 m (3.3 ft) and about 2 m (6.6 ft). The rail assemblies may also be connected by a hinge to facilitate transportation and storage. A hinged joint between the two rail assemblies also permits the angle of inclination to be increased. The rail assemblies are each inclined toward the apical midpoint at an angle of, for example, between about 1° and about 30°, between about 1° and about 10°, or between about 2° and about 6° (e.g., about 4°).

Each rail assembly is slidably engaged with a trolley by a linear slide mechanism, such as a linear ball-bearing slide mechanism or rotatable wheels having multiple points of contact, for example points of contact on the top (vertical contact) and side (horizontal contact), and optionally the bottom side, of a rail assembly. In one example, linear slides are akin to drawer slides used in the unrelated field of cabinetry. The trolleys are securely engaged with corresponding rail assemblies so that the trolleys do not become easily disengaged from the rail assemblies during operation. The exercise apparatus may include a right-handed trolley and a left-handed trolley, with each trolley optionally having a hand-gripping handle rotatable toward the apical midpoint. Each trolley may also have an armrest member that is rotatable during operation, the rotation occurring about a central longitudinal axis formed by a user's forearm. Because the rail assemblies are linear, the armrest member rotates with respect to the trolley during operation. That is, each trolley has internal moving parts that reorient themselves as the exercise motion progresses (the components of the trolley rotate with respect to each other).

According to another embodiment, exercise apparatus 10 for performing an armless (i.e., bent-elbow plank position) push-up includes two upwardly inclined linear rail assemblies 20, 30 meeting at apical midpoint 12 and two moveable trolleys 40, 50, wherein each rail assembly is engaged with a moveable trolley, wherein each trolley is independently operable and slidable up and down a rail assembly, and wherein the trolleys include armrest members 43, 53 anatomically compatible with (i.e., sized and configured to engage with) a human forearm and rotatable during operation about a longitudinal central axis formed by a user's forearm. For example, armrest members 43, 53 rotate within the trolley in a natural movement for each forearm.

According to yet another embodiment, exercise apparatus 10 for performing an armless (i.e., bent-elbow plank position) push-up includes first rail assembly 20 having two co-planar linear inclined rail members 22, 24 and second rail assembly 30 having two co-planar linear inclined rail members 32, 34, the elevated ends 29, 39 of the two rail assemblies meeting at apical midpoint 12, wherein first rail assembly 20 and second rail assembly 30 are symmetrical and joined by hinge 99; right-handed trolley 40 mounted to first rail assembly 20 and slidable thereupon; and left-handed trolley 50 mounted to second rail assembly 30 and slidable thereupon; wherein trolleys 40, 50 include armrest members 43, 53 anatomically compatible with (i.e., sized and configured to engage with) a human forearm, the armrest member being rotatable during operation about a central longitudinal axis formed by a user's forearm.

An exemplary method of using such an exercise apparatus for strength conditioning the pectoral muscles of a human operator includes steps of (a) placing the exercise apparatus on a level surface (e.g., a floor, bench, table, or exercise mat); (2) placing the forearms of a human operator in the armrest members of the trolleys while in a prone position; and (3) iteratively abducting and adducting the arms by contracting the pectoral muscles to thereby slide each trolley upward and downward along each rail assembly. Typically the operator's upper body weight is supported by the exercise apparatus, and the lower body weight is supported by the feet or knees, which, for example, are in contact with the level surface. The intensity of the strength conditioning exercise may be increased, for example, attaching a removable elastic tension band of predetermined resistance between a trolley and a fixed point on the exercise apparatus to thereby providing resistance to movement of the trolley during operation. The angle of inclination may also be increased, or the operator's upper body may be subjected to additional weight (e.g., a weighted vest).

This disclosure now turns to a discussion of various details that may be incorporated in accordance with at least one embodiment as illustrated in the attached drawings. The details discussed hereinbelow are meant to be illustrative instead of restrictive, and it thus should be understood that there remain a very wide variety of possible implementations for the methods and systems within the spirit and scope of the appended claims.

An embodiment of an exercise apparatus for performing an armless push-up is illustrated in FIGS. 1-25. Referring specifically to FIGS. 1-8, gravity-driven resistance exercise apparatus 10 is illustrated. Apparatus 10 includes first rail assembly 20 and second rail assembly 30. In the embodiment illustrated in the drawings, first rail assembly 20 is on the right-handed side of apparatus 10, and second rail assembly 30 is on the left-handed side of apparatus 10. First rail assembly 20 has two rail members 22, 24, and second rail assembly 30 also has two rail members 32, 34. Although rail assemblies 20, 30 are depicted in the drawings as each having two rail members, alternative exercise apparatus configurations may include rail assemblies having only one rail member (a monorail) or three or more rail members.

Still referring to the attached drawings, first rail assembly 20 includes a first rail member 22 having top surface 23, and a second rail member 24 having top surface 25. First rail member 22 and second rail member 24 run parallel to one another and are securably connected by support members 26, 28. In the embodiment shown in FIGS. 1-8, elevational and lateral support members 26 and 28, each of which extends substantially perpendicularly to the rail members, are affixed to and attach first and second rail members 22, 24. Those skilled in the art will be able to recognize and determine an appropriate separation distance between first and second rail members 22, 24. In a preferred embodiment, rails 22, 24 are separated by about 20 cm to about 25 cm (8 into 10 in).

Second rail assembly 30 is essentially a mirror-image of first rail assembly 20, and as such includes the same elements, namely, a first rail member 32 having top surface 33, and a second rail member 34 having top surface 35. First rail member 32 and second rail member 34 run parallel to one another and are securably connected. In the embodiment shown in FIGS. 1-8, elevational and lateral support members 36 and 38, each of which extends substantially perpendicularly, are affixed to and attach first and second rail members 32, 34.

Rail members 22 and 24 of first rail assembly 20 are each configured and disposed to lie within an inclined plane, that is, top surfaces 23, 25 are co-planar. Lower ends 27 of rails 22, 24 are smaller than opposing higher ends 29, which are bigger (higher). Thus configured, top surface 23 extends from lower end 27 to higher end 29 of first rail member 22 in a sloped or ramp-like manner so that the entire first rail assembly 20 resembles and acts as an inclined plane. First rail member 22 and second rail member 24 are preferably the same size and shape as one another. The same holds true for first rail member 32 and second rail member 34 of second rail assembly 30, each of which has lower end 37 that is smaller than opposing higher end 39. A sloped top surface extends between ends 37 and 39, so that the entire rail assembly 30 resembles and acts as an inclined plane.

As shown in FIGS. 1-8, first rail assembly 20 and second rail assembly 30 are positioned lengthwise (horizontally 180°) in relation to one another so that higher ends 29 of first and second rail members 22, 24 abut higher ends 39 of first and second rail members 32, 34. This abutting rail assembly arrangement is also referred to herein as being opposed. At this abutment, first and second rail assemblies 20, 30 are joined together thereby forming midpoint 12 of apparatus 10.

Figure 6:
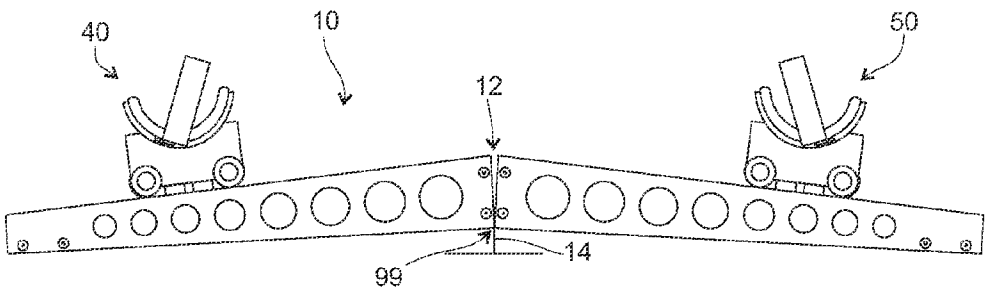
FIG. 6 is a front view of the apparatus shown in FIGS. 1-5.
Figure 19:
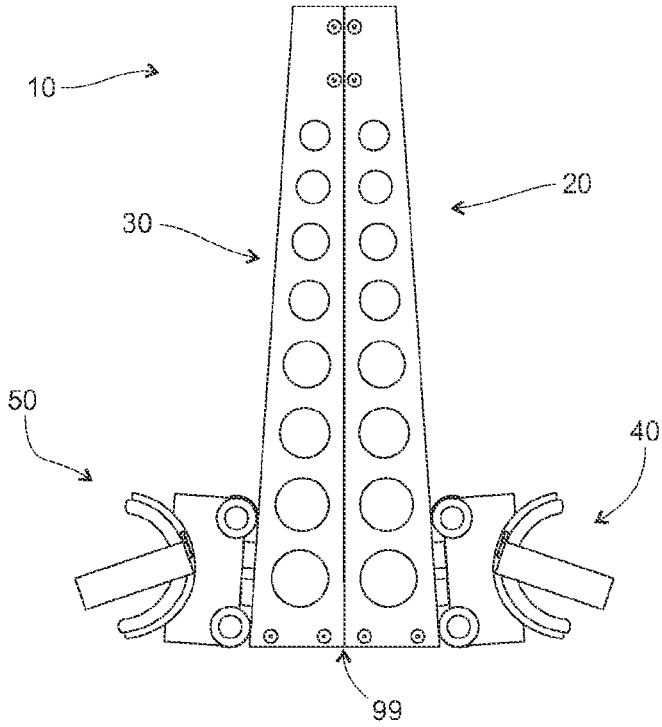
FIG. 19 is a side view of the exercise apparatus folded about a centerline hinge.
Figure 20:
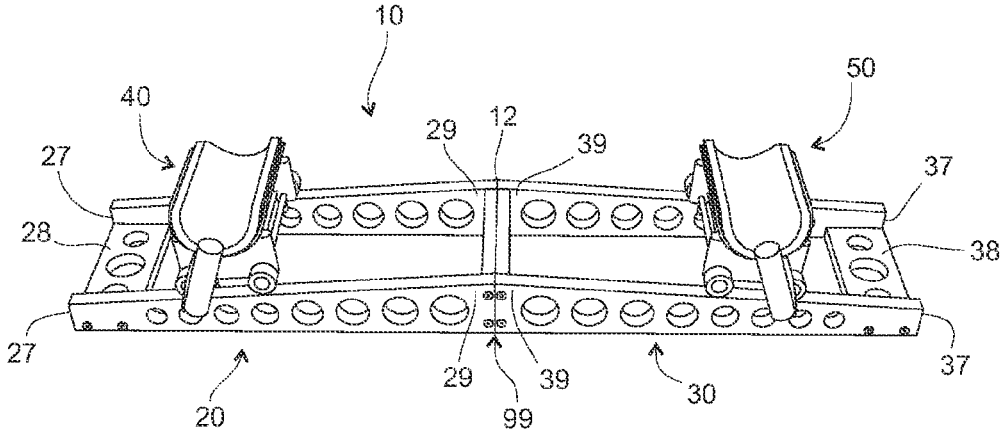
FIG. 20 is a front perspective view of the apparatus of FIGS. 1-8 without a human operator.
Figure 21:
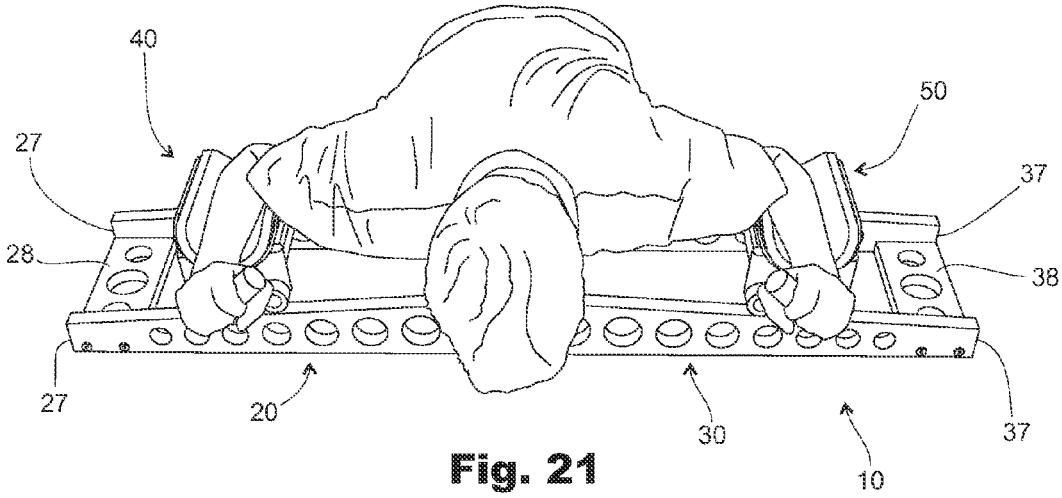
FIG. 21 is a front perspective view of the apparatus of FIG. 20 with a human operator having completed a downstroke motion.

Any suitable joint may be used to secure first rail assembly 20 to second rail assembly 30. In a preferred embodiment, hinge 99 attached to the bottom surfaces of assemblies 20 and 30 is used. If rubber feet are included on the underside of apparatus 10, it may be desirable to stagger them so that the machine folds upon itself. An added benefit is that the device can be folded 180° degrees on hinge 99 to increase portability and make for easier storage as illustrated in FIG. 19. Still another advantage is that a hinge allows for a controlled, uniform increase in incline angle 11 of each rail assembly 20, 30 by placing a spacer (such as a book or a common lumber stud) under the abutment proximate to midpoint 12 to thereby raise the midpoint further from the floor during use. Such center elevation 14 is illustrated in FIG. 6. Likewise, distal ends of the two rails could be tied together with a short non-elastic cord to thereby raise the midpoint off the ground.

Generally speaking, the inclined plane is one of the classical six simple machines (i.e., a device that only requires the application of a single force in order to work; the others being the lever, wheel/axle, pulley, wedge, and screw). As its name suggests, a plane is a flat surface whose endpoints are at different heights. The laws of mechanics and physics teach that when a body is placed on an inclined plane it will move with constant acceleration.

The inventor has surprisingly discovered a novel and superior resistance exercise apparatus and method that capitalizes upon one or more of an inclined plane's inherent properties. Upon using exercise apparatus 10, the increase in slope or incline 11 along the rails moving from lower ends 27, 37 towards higher ends 29, 39 at midpoint 12 (which slope is greater than 0°, preferably greater than about 1°, or more preferably between about 1° and about 30°, or even more preferably between about 1° and about 10°, or most preferably between about 2° and about 6°, e.g., about 4°).

Figure 5:
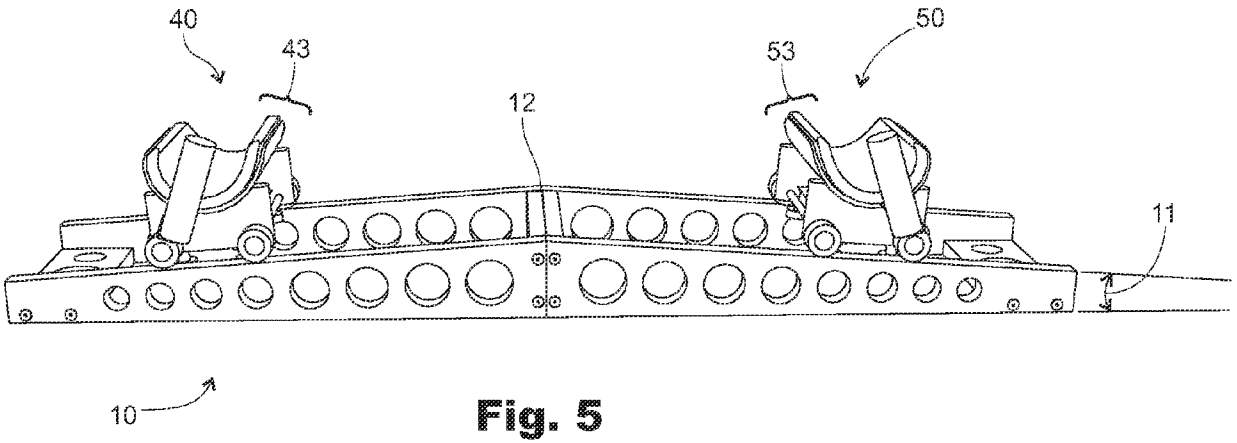
FIG. 5 is a front top elevation view of the apparatus shown in FIGS. 1-4.

Inclination angle 11 is the angle formed by the upward sloping incline and the base of apparatus 10 (e.g., the floor upon which apparatus 10 rests during use). Accordingly, when apparatus 10 is lying flat on the floor, angle 11 is the angle formed by the floor and the upward sloping incline as illustrated in FIG. 5. The slope of the rails makes use of gravity to cause equal acceleration of trolleys 40, 50, thereby centering the user's body over midpoint 12 of apparatus 10.

Figure 7:
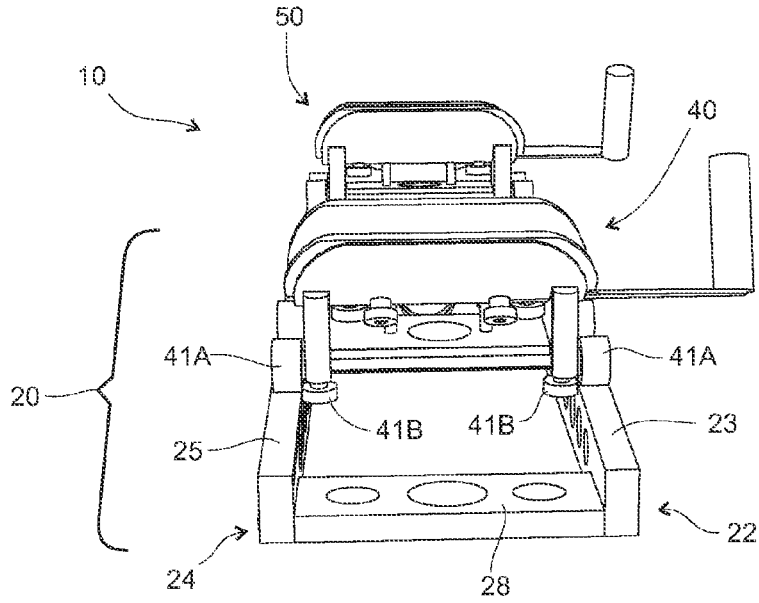
FIG. 7 is a side perspective view of the apparatus shown in FIGS. 1-6.
Figure 8:
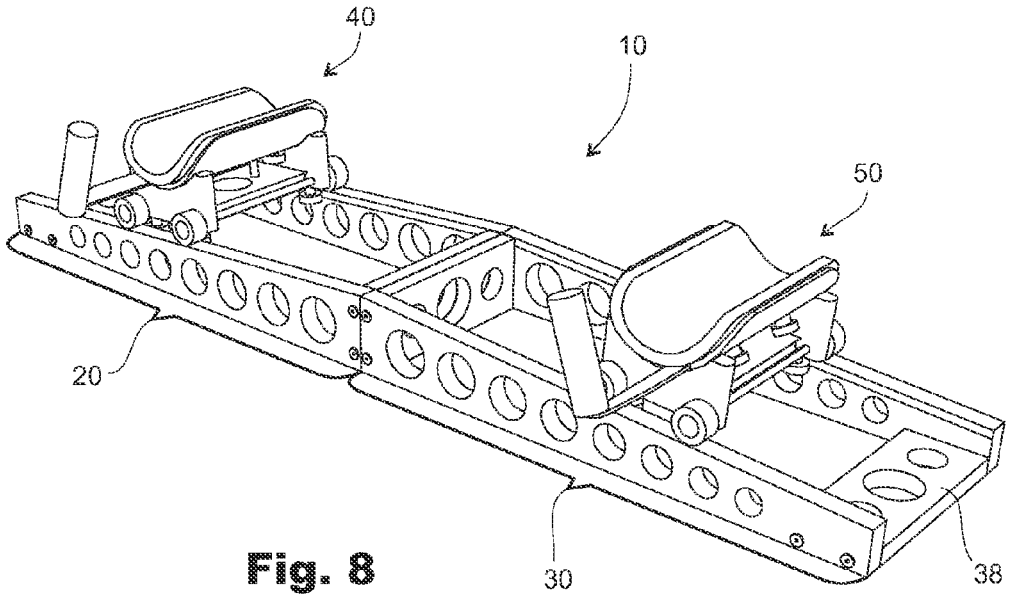
FIG. 8 is a front perspective view of the apparatus shown in FIGS. 1-7.
Figure 9:
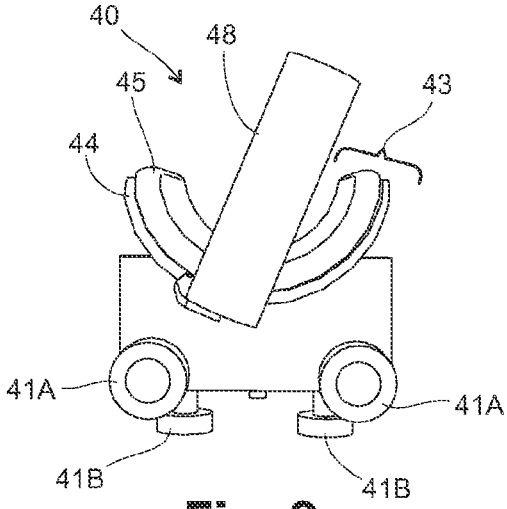
FIG. 9 is a front view of one of the right-handed trolleys shown in FIGS. 1-8.
Figure 10:
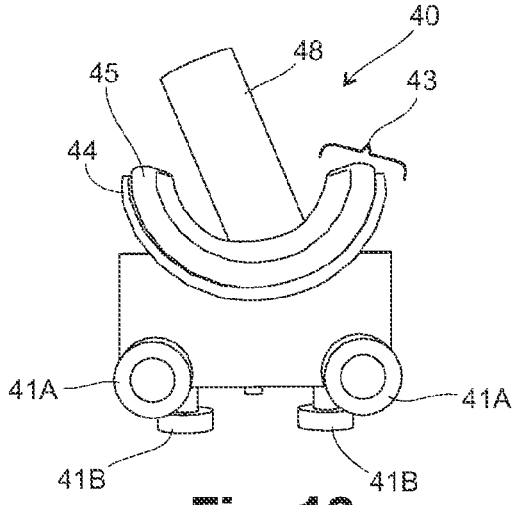
FIG. 10 is a rear view of the trolley shown in FIG. 9.
Figure 11:
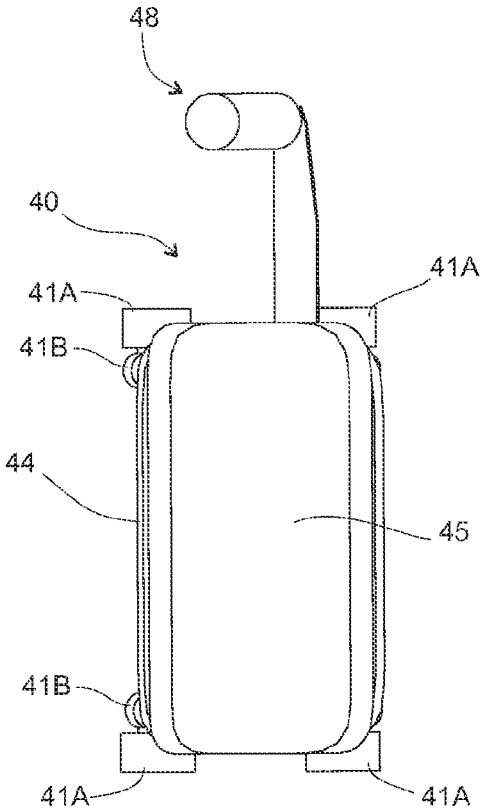
FIG. 11 is a top view of the trolley shown in FIGS. 9-10.
Figure 12:
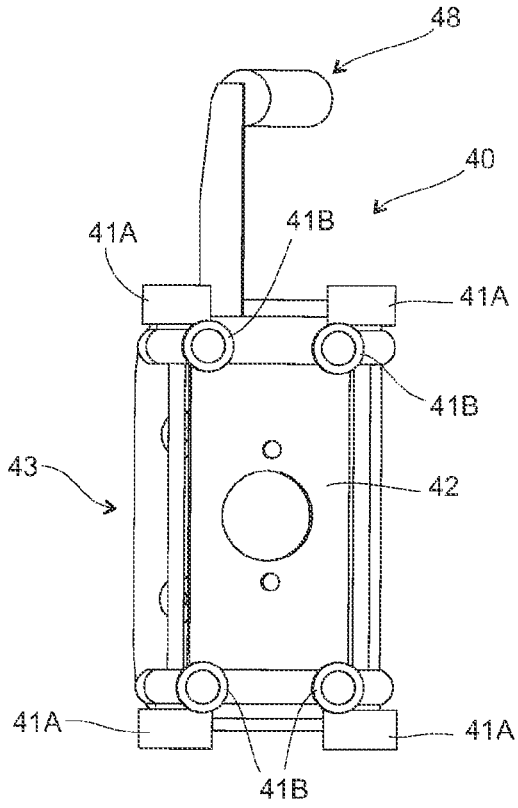
FIG. 12 is a bottom view of the trolley shown in FIGS. 9-11.
Figure 13:
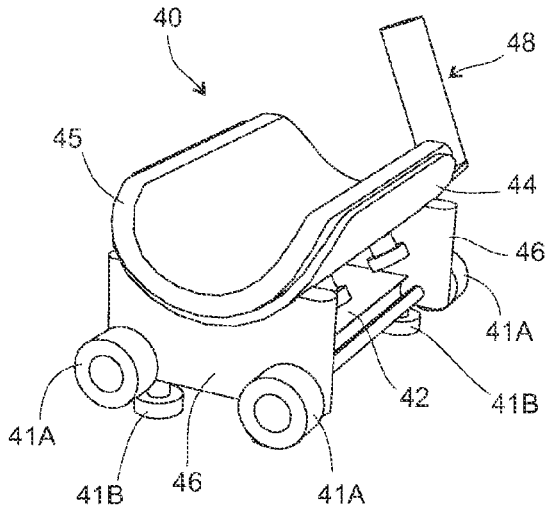
FIG. 13 is a top perspective view of the trolley shown in FIGS. 9-12.
Figure 14:
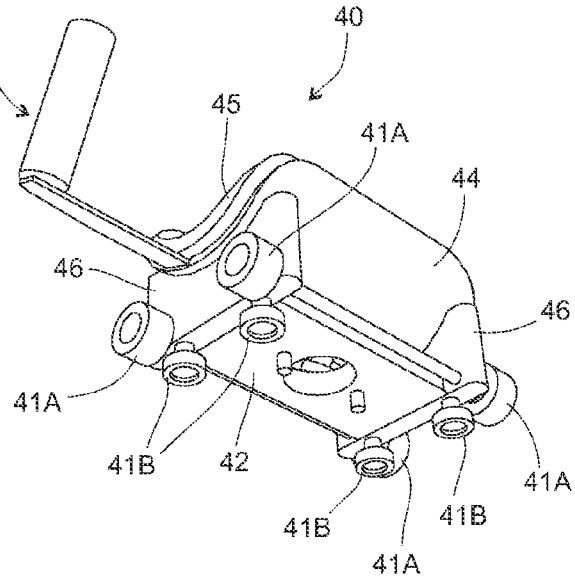
FIG. 14 is a bottom perspective view of the trolley shown in FIGS. 9-13.
Figure 15:
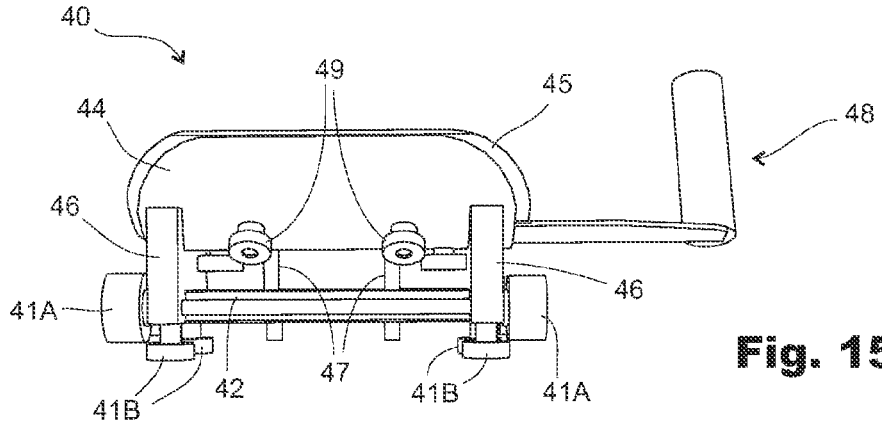
FIG. 15 is a side view of the trolley shown in FIGS. 9-14.
Figure 16:
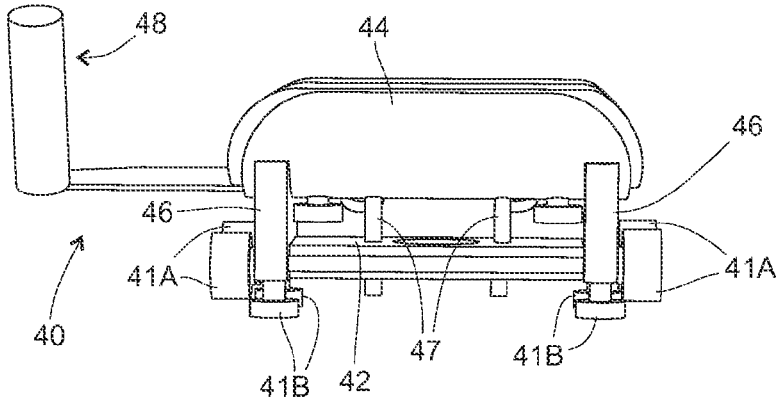
FIG. 16 is an opposite side view of the trolley shown in FIG. 15.
Figure 17:
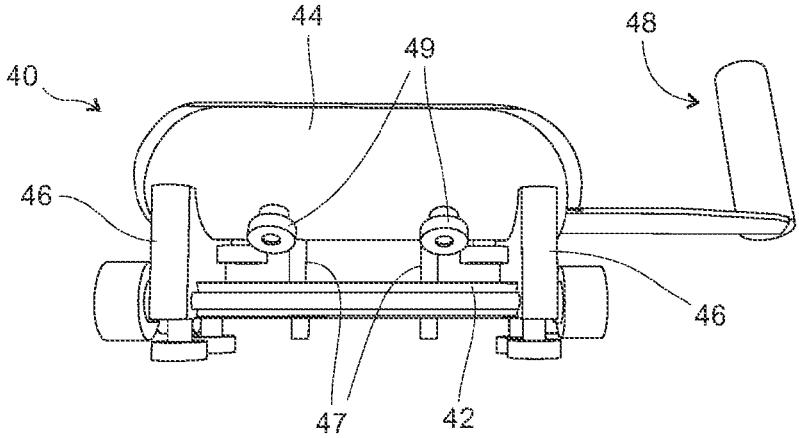
FIGS. 17-18 are additional side views of the trolley shown in FIGS. 9-16.
Figure 18:
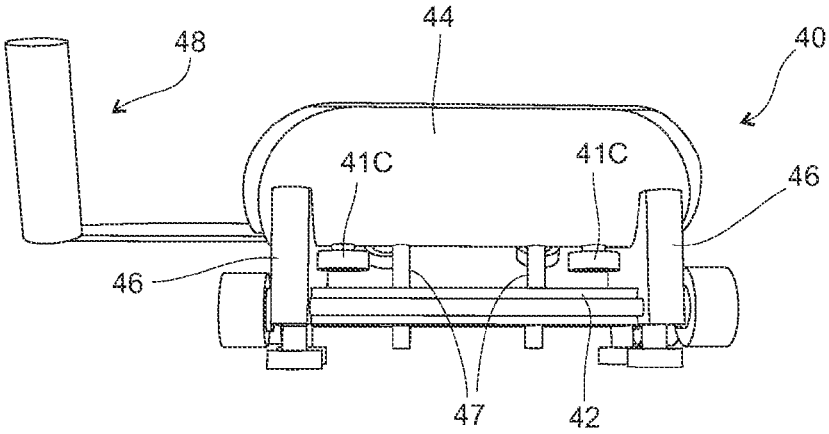

A weight bearing trolley 40 (which may also be referred to herein as a "cart" or "carriage") is configured to slidably move along top surfaces 23, 25, and roll on first and second rail members 22, 24 of first rail assembly 20. As shown in FIGS. 9-18, trolley 40 uses four sets (i.e., pairs) of wheels 41 oriented so the trolley does not unintentionally lose contact with the rail assembly, much like wheels often employed on amusement park roller coasters. Four of wheels 41A are side-mounted on vertical cradles 46 and are configured to mate with (make contact with) top surfaces 23, 25 as illustrated in FIG. 7. Four additional wheels 41B, are bottom-mounted under platform 42 and are configured to mate with (make contact with) the sides of first rail member 22 and second rail member 24, also as illustrated in FIG. 7. Note that trolley 40 is prevented from disengaging from first rail assembly 20 by a bumper, stop, or another such similar locking mechanism (not pictured) that interferes with the pathway of wheels 41B. Top surfaces 23, 25 may have a lip (not pictured) that slightly extends beyond the rail members and prevents wheels 41B from disengaging from rail members 22, 24. For example, top surfaces 23, may be made from extruded or molded rigid plastic, which permits formation of a sturdy lip that locks wheels 41B and which provides a low-friction interface with wheels 41A.

Right-handed trolley 40 is fitted with armrest member 43 so that the FLYE-UP™ exercise motion (a term coined by the inventor for the novel prone exercise motion created using the apparatus, and sometimes also referred to herein as an "armless" push-up) can be performed. Trolley 40 can be further fitted with a hand-gripping handle 48 so that a bent-elbow plank position FLYE-UP™ or extended arm exercise can be selectively performed by a human user. Second rail assembly 30 also has left-handed trolley 50 that is positioned and configured to slidably move along top surfaces 33, 35 of first and second rails 32, 34, ideally displaying the mirror image size, feature, motion, friction, and resistance characteristics of trolley 40. That is, apparatus 10 is symmetrical and complementary to the left and right anatomical features of the human body. Note that right-handed trolley 40 and left-handed trolley 50 are non-superimposable mirror images of each other. Accordingly, left-handed trolley 50 is fitted with armrest member 53 and hand-gripping handle 58.

Each weight-bearing trolley 40, 50 is itself an inventive aspect of the apparatus and methods described herein. For the sake of brevity and convenience, the following discussion is with respect to right-handed weight-bearing trolley 40, it being understood that left-handed trolley 50 is a mirror image of trolley 40, in much the same manner as first rail assembly 20 is a mirror image of second rail assembly 30.

Referring to right-handed trolley 40 in FIGS. 9-18, trolley 40 includes armrest member 43 that includes shell 44 and cushion or padding layer 45, as well as hand-gripping handle 48. Shell 44 is formed to complement, support, and otherwise be compatible the anatomy of the forearm of a human user. For example, it maybe semi-circular in cross-section (for example, a plastic half-pipe), and it of sufficient radius to accommodate and support a user's forearm. In order to permit the user to perform an armless push-up, armrest member 43 should engage with the forearm of the human user in such a manner that during operation unnecessary and unproductive muscle work is not required in order to maintain armrest member 43 in contact with the user's forearm. To this end, it is unlikely that a simple planar armrest member 43 would be satisfactory because the user's forearm would likely become easily disengaged from (e.g., slide off of) such an armrest. Accordingly, half-cylinder and half-cone shapes are examples of preferred geometries for armrest member 43 (as well as shell 44).

In the preferred embodiment shown in FIGS. 1-25, shell 44 bridges and rests upon, but is not immovably fixed or attached to vertical cradles 46. However, in other embodiments, cradles 46 may be of different shapes and configurations. For example, cradles 46 or shells 44 may be of different configuration, such as to permit a user to place a foot (rather than forearms) on each trolley to perform standing adductor and abductor leg exercises. Additionally, trolleys 40, 50 can include safety features such as pinch guards to prevent a user from pinching between wheels 41 and the device or between wheels 41 and the rails.

Because the user's body weight provides the resistance for the exercise, weight displacement or movement is a component of the exercise to be performed with apparatus 10. The inventor has discovered that during the execution of an armless push-up on apparatus 10, the user's forearms tended to change their position relative to the weight-bearing portions of trolleys 40, 50 throughout the entire range of motion (see FIGS. 21-25). This change in relative position could result in the user experiencing discomfort and pain, such as by friction of the skin and muscles placed within the cradle 46 during the movement of the trolley 40. Discomfort also undesirably restricts the range of motion a user is willing to experience while using the apparatus.

In particular, the contact point between the user's forearm and armrest member 43 would roll, causing pinching or even chafing of the skin after numerous repetitions. A user who wished to continue exercising would then typically compensate by controlling forearm motion in an unnatural way to avoid further pain and discomfort. Such compensation, in turn, results in less effective strength conditioning or exercise.

The novel exercise apparatus herein solves the foregoing problem and provides for a method of resistance exercise that is very comfortable. For example, the inventor discovered that if the weight-bearing portion of armrest member 43 could be maintained in constant position relative to the user's arms (rather than relative to apparatus 10) throughout the entire range of motion, any pain or discomfort would be minimized or alleviated.

Specifically, by making shell 44 capable of rotating freely in cradles 46, there would no longer be any rolling motion between the user's forearms and the point at which they contacted the armrest, that is, the inside padded, curved portion of shell 44. The exercise apparatus permits the user to perform an armless push-up whereby the user places the forearms into armrest members 43, 53 while in a prone (face-down) position. The user then grasps optional hand-gripping handles 48. The user then attempts to raise his upper body up from the apparatus while bringing the elbows underneath the chest. By performing such an exercise, muscle fatigue in the forearms, wrists, and hands is limited. Indeed, the forearms, which are resting in armrest members 43, 53 need not perform any significant work whatsoever.

There are various suitable configurations and adaptations available for the swivel-like attachment of shell 44 to trolley 40. In the embodiment shown in FIGS. 9-18, for example, armrest member 43 is permitted to swivel freely in the cradles 46, yet within a limited range of rotation controlled by attaching shell 44 to horizontal platform 42 of the cart via a flexible attachment such as resilient elastic latex exercise band 47 as illustrated in FIGS. 15-18. In order to limit friction between shell 44 and cradles 46, mating surfaces may be covered with, for example, polytetrafluoroethylene tape, such as TEFLON® brand tape.

Still referring to FIGS. 15-18, elastic bands 47 are attached to platform 42 and the underside of shell 44. Shell 44 is not permanently attached to cradles 46, it being held in place by the tension of bands 47. During operation, shell 44 rotates in cradles 46, the extent of rotation depending, in part, on the strength of elastic bands 47. Elastic bands 47 may be secured to platform 42 by a knot tied at both ends of band 47 (the knot being too large to transit the through hole in platform 42). For the sake of clarity, it should be noted that band 47 is not provided to create meaningful resistance related to the trolley movement inherent in the main exercise, rather is present to permit controlled rotation of the weight-bearing portion of armrest 43 and thereby alleviate pain and discomfort that the user might otherwise experience from his forearm rubbing against the inside of shell 44. A further purpose for band 47 is that it permits some rotation of shell 44 in cradles 46 while still maintaining trolley 40 as one unit. The aforementioned configuration allows shell 44 to swivel within cradles 46, which in turn remain rigidly affixed to the rest of trolley 40. It also assures that shell 44 will be held to trolley 40 when apparatus 10 is moved. In addition, shell 44 re-centers itself during the exercise's downstroke, preferably with the help of band 47 or other such flexible attachment.

To prevent undesirable lateral movement of shell 44 in cradles 46, wheels 41C are affixed to the bottom of shell 44. Wheels 41C abut the sides of cradles 46, and they prevent shell 44 from moving laterally. Preferably, wheels 41C do not otherwise inhibit the rotational movement of shell 44 with respect to cradles 46.

Additional features may include replacement elevational support members 26, 36 having selectable holes to allow for a desired increase in the height of the rail ends 29, 39 from the floor. It will be appreciated that the slope of apparatus 10 may also be increased by providing a removable spacer under the midpoint 12 of the apparatus formed by the abutting ends of each rail assembly 20, 30 to thereby provide center elevation 14 as illustrated in FIG. 6. In such embodiments, the user can selectively adjust the degree of incline of rail assemblies 20 and 30 to provide controlled and desired levels or increased and decreased exercise resistance. Handle grip adjustments 49 (such as thumbscrew fasteners illustrated in FIG. 17) may be included to permit hand-gripping handles 48 to be repositioned farther or closer to armrest member 43.

An armless push-up exercise involves the following sequence of steps and bodily movements, which are illustrated in FIGS. 20-25. As stated previously, it is the inclined nature of rail assemblies 20, 30 that ensures centered user balance and smooth body-weight resistance during use of apparatus 10. Moreover, the more top surfaces 23, 25 and 33, 35 come to lying in a horizontal plane, the easier the exercise motion becomes. Similarly, the greater the degree of slope or incline, the harder that same motion becomes.

Figure 22:
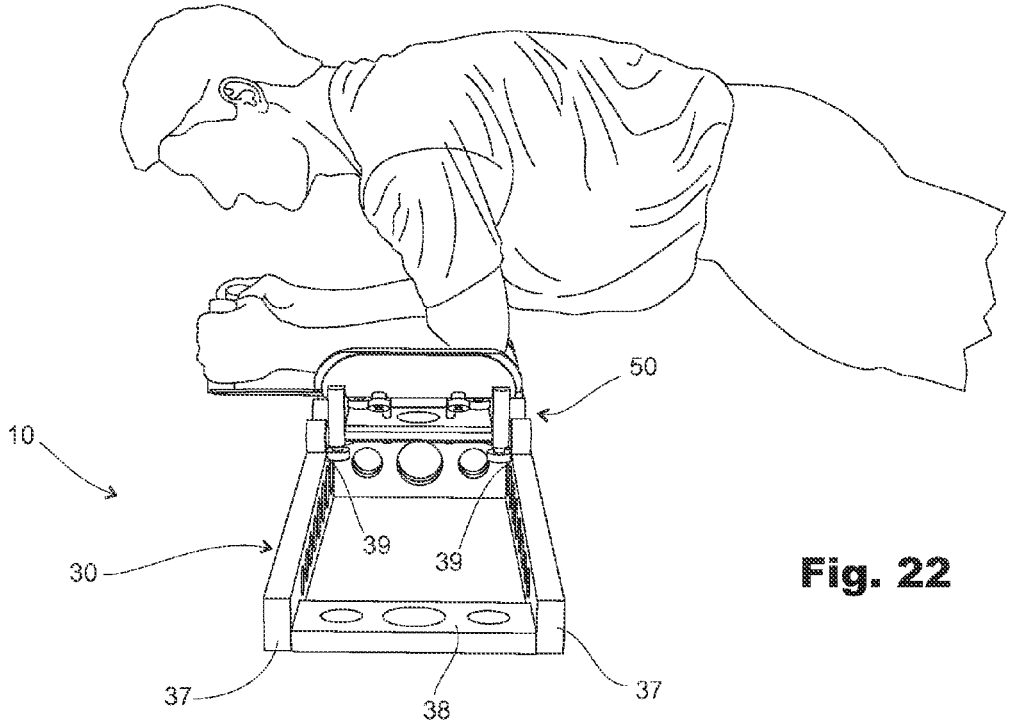
FIGS. 22-23 are side and front perspective views, respectively, of the apparatus of FIG. 21 with a human operator having completed an upstroke motion.
Figure 23:
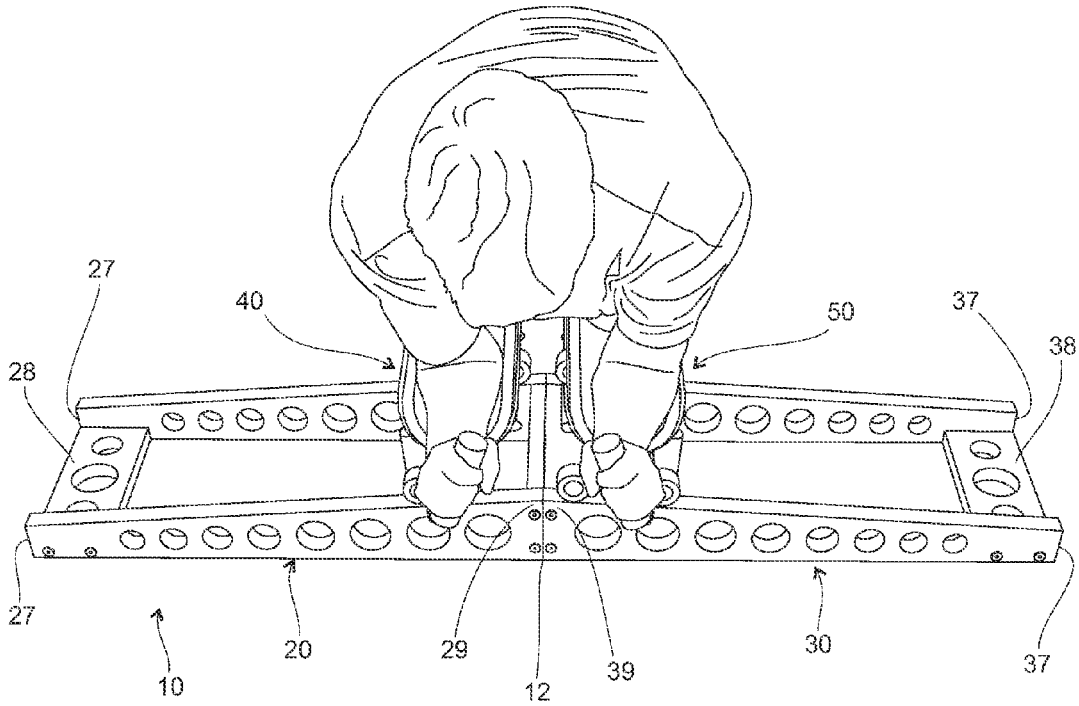

In an exercise embodiment, apparatus 10 is placed upon a level surface. A user rests his forearms in arm rest members 43, 53 of trolleys 40, 50, and positions trolleys 40, 50 at or near apparatus midpoint 12 as illustrated in FIGS. 22-23. The user then assumes a traditional push-up position with the rest of the user's weight supported on the floor by the user's toes, feet, or knees. In a yoga-inspired, bent-elbow plank configuration with the user's elbows flexed to approximately 90° (i.e., the angle formed by the shoulder to the elbow to the hand). Alternatively and additionally, a user can selectively vary the body weight exerted over the apparatus, such as by placing weight on the user's knees, placing the user's feet on an elevated surface relative to the apparatus 10, placing the user's feet on a lower surface relative to the apparatus 10, adjusting the user's weight on one knee or foot, wearing weight vests or having a second user exert downward or upward force on the user's body, among other things. Each of these exercises has been found naturally to exert additional exercise on the user's body, such as tightening of the stomach and other core muscles of a user's torso, as well as tensing of the legs. These additional exercise benefits are significant, and are additional advantages of the apparatus and its methods of use.

Figure 24:
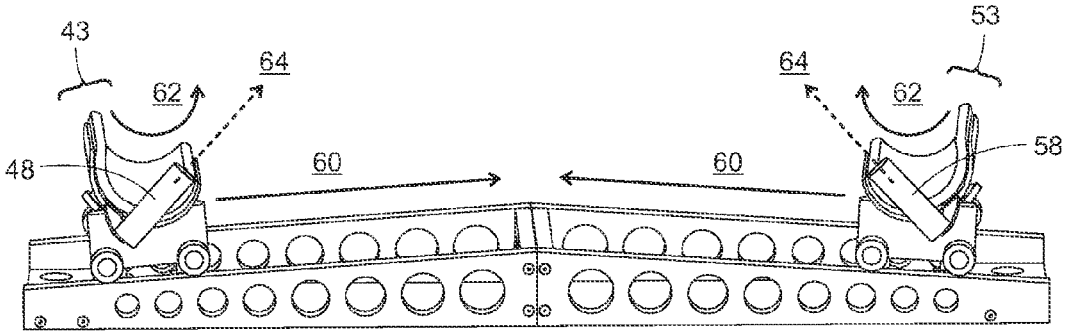
FIGS. 24-25 illustrate the relative motion of the armrest members during upstroke and downstroke motions.
Figure 25:
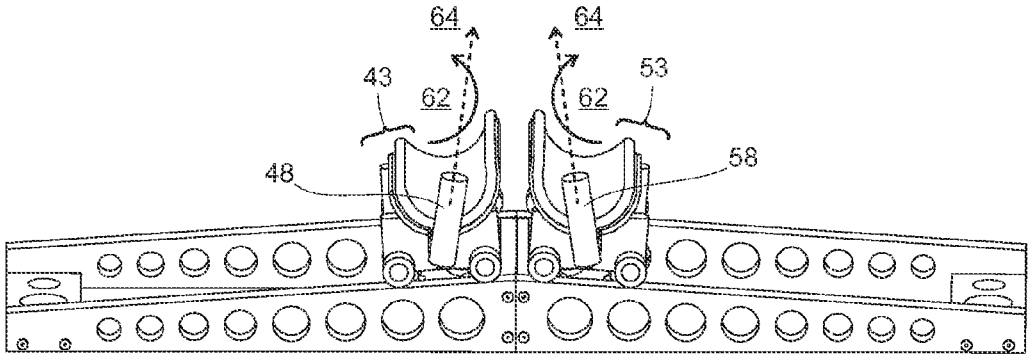

To initiate the exercise motion, the user grasps hand-gripping handles 48, 58. Note that gripping handles 48, 58, as illustrated in FIGS. 24-25, are preferably oriented inward toward midpoint 12 so that the user's forearms are in a natural and comfortable position through out the exercise. Beginning with the trolleys 40, 50 near midpoint 12 (see FIGS. 22-23 and 25), the user allows trolleys 40, 50 to descend from higher ends 29, 39 towards lower ends 27, 37 of apparatus 10 in a controlled fashion (the "downstroke") to arrive at the position illustrated in FIG. 21.

In order for the user to lift his body weight, he must move his hands, forearms, upper arms, shoulders, etc. towards the center 12 of apparatus 10 and thereby cause the trolleys 40, 50 to ascend the incline of each rail assembly until the user returns to the starting point (the "upstroke") as illustrated in FIG. 24. That sequence is then repeated until the desired user muscle fatigue is accomplished. The intensity of the exercise may be increased by attaching elastic tension bands from each trolley to a fixed point on apparatus 10, such as lateral support members 28, 38. During the exercise, trolleys 40, 50 move up and down rail assemblies 20, 30 while the user's chest and upper body moves vertically.

The rotary and linear motions of the components of apparatus 10 during the upstroke are illustrated in FIGS. 24-25. The trolleys linearly ascend (sliding motion 60) the rail assemblies as the user rotates (rotating motion 62) his forearms and armrest members 43, 53, while maintaining the hand-gripping handles 48, 58 pointed (direction 64) toward the users body. The reverse motions are performed in the downstroke, and the process is repeated.

The design of prior art devices was such that it was difficult, if not impossible, for a user to keep the weight-bearing devices equidistant from the midpoint of his body or the center position of the exercise movement. If the weight-bearing devices moved away from one another at different rates, the user would most likely become unstable and ultimately lose his balance, thereby risking injury. Previous attempts to address that problem and maintain the weight-bearing elements of their devices equidistant from the midpoint involved the creation of various linkages between the weight-bearing elements. The hope was that such linkages would insure that the weight-bearing elements would both move away at the same rate, thereby keeping the user balanced in the center.

The present invention, therefore, is a significant improvement over heretofore known exercise equipment. With respect to the apparatus described in GB Publication No. 2,274,999, the exercise apparatus is not directed to an isolated pectoral muscle exercise (i.e., an armless push-up), and it is unclear what upper body muscles are trained or strengthened in the movements illustrated therein. When this prior art apparatus is used to perform a push-up exercise, there inevitably will be some arm and shoulder loading, while adduction of the arms is primarily via the pectoral muscles. Also, the belts pull the carts toward the midline, which would reduce the amount of adduction work and thereby limit load on the pectoralis. This, of course, is the opposite effect achieved by the present invention. Moreover, according to this prior art reference, near the midline the tracks appear almost horizontal and parallel, and that is the key moment when the carts need the outward acceleration to keep the body weight centered, which affect is achieved by the present invention.

Also, with respect to the apparatus described in U.S. Pat. No. 7,134,987, the exercise apparatus is similarly not directed to an isolated pectoral muscle exercise (i.e., an armless push-up). For example, the apparatus is gripped with the hands and therefore the arm and hand muscles perform work, whereas the apparatus of the present invention isolates the pectoral muscles and the arms and hands perform substantially no work. Moreover, the prior art apparatus uses tension bands to return the carts to the center, which lessens the amount of muscle work on the chest, whereas according to the present invention the user must overcome the weight of gravity on his body in order to perform the upstroke motion.

Unlike the foregoing prior art machines, the "armless" aspect of the present invention represents a significant improvement in that is permits isolation of the pectoral muscles and prevents fatigue of the arm muscles. Moreover, the swivel action of forearms rest members 43, 53 which feature is novel with respect to the prior art, allows for a natural range of motion with gravity pulling to keep the body weight centered. The present invention significantly reduces, if not virtually eliminates, the above-described asymmetric movement problems. Starting with trolleys 40, 50 both positioned near midpoint 12, gravity accelerates the trolleys away from midpoint 12 at an equal rate. The effect is that each time the user returns trolleys 40, 50 to the top of the upstroke at midpoint 12, he need only relax briefly to begin the downstroke (just like one does when performing a regular push-up, pull-up, or sit-up). The user's body weight is then naturally self-centered as the trolleys move laterally downward again and away from midpoint 12.

The inclined slope of apparatus 10 even allows a user to perform a traditional push-up, where his arms are full extended and hands resting on the trolleys (preferably with alternate-shaped, rather than half-pipe shaped, cradles 46, insert shells 44, or pads 45). Without such incline, the same maneuver would be very difficult. That is, if the rails of the apparatus were entirely horizontal and a user assumed a traditional, extended-arms push-up posture with his hands close to one another near the midpoint, he would find himself in a very unstable position. The user could, and would, easily sway. As a result of this imbalance, one of the trolleys 40, 50 would begin to move while the other remained motionless; i.e., there would be nothing to cause the other trolley necessarily to begin moving. The end result would be that as the user's body weight was lowered (as intended), with the trolley that started moving first would move twice as far while the other remained motionless.

When a user supports his body weight on the forearms, as in one preferred embodiment of the exercises described herein, it results in a much lower posture and thus reduces the aforementioned problems with imbalance and asymmetric movement of the weight-bearing elements exhibited by prior art devices. Surprisingly, the inclined nature of the present invention which causes the trolleys 40, 50 to naturally and gravitationally move laterally and is so effective it even allows a user to perform a more traditional push-up on apparatus 10 with his hands on trolleys 40, 50 and arms fully extended.

The apparatus has been constructed by the inventor in several embodiments using a variety of materials (wood, plastics, metals, etc). The inventor has subjected the apparatus to numerous test runs and has endured thousands of repetitions without the user losing his balance or experiencing pinching/chafing on the forearms. As designed and constructed, trolleys 40, 50 almost never, if ever, move away from midpoint 12 in an asymmetric fashion during an exercise motion. The apparatus provides a novel, vigorous exercise that produces pectoralis resistance without fatiguing arm and shoulder muscles, a combination heretofore unseen in prior art portable exercise equipment.

The manner in which the apparatus is constructed results in benefits beyond physical fitness. Known prior art devices typically involve much more elaborate assemblies, and thus are more time-consuming to manufacture. Such devices often make use of pulleys, cables, metal fabrication and the like, making the manufacturing process expensive, perhaps even pushing the sales price beyond a point that the market will bear and still allow the manufacturer a sufficient profit. By contrast, the apparatus and method of the present invention make use of inclined planes to achieve superior results over any similar prior art push-up exercise devices.

While this description is made with reference to exemplary embodiments, it will be understood by those skilled in the art that various changes may be made and equivalents may be substituted for elements thereof without departing from the scope. In addition, many modifications may be made to adapt a particular situation or material to the teachings hereof without departing from the essential scope. Also, in the drawings and the description, there have been disclosed exemplary embodiments and, although specific terms may have been employed, they are unless otherwise stated used in a generic and descriptive sense only and not for purposes of limitation, the scope of the claims therefore not being so limited. Moreover, one skilled in the art will appreciate that certain steps of the methods discussed herein may be sequenced in alternative order or steps may be combined. Therefore, it is intended that the appended claims not be limited to the particular embodiment disclosed herein.

The invention claimed is:

1. An exercise apparatus for performing a bent-elbow plank position push-up comprising:

two upwardly inclined linear rail assemblies meeting at an apical midpoint and two moveable trolleys, wherein each rail assembly is engaged with a moveable trolley, each trolley is independently operable, each trolley comprises an armrest member sized and configured to engage with a forearm of a human user, and each armrest member is rotatable with respect to the trolley and is rotatable around a central longitudinal axis formed by the user's forearm.

2. The exercise apparatus according to claim 1, wherein the rail assemblies are each inclined toward the apical midpoint at an angle of between about 1° and about 30°.

3. An exercise apparatus for performing a bent-elbow plank position push-up comprising:

two upwardly inclined linear rail assemblies meeting at an apical midpoint and two moveable trolleys, wherein each rail assembly is engaged with a moveable trolley, each trolley is independently operable and slidable up and down a rail assembly, each trolley comprises an armrest member sized and configured to engage with a forearm of a human user, and each armrest member is rotatable with respect to the trolley and is rotatable around a central longitudinal axis formed by the user's forearm.

4. An exercise apparatus for performing a bent-elbow plank position push-up comprising:

a first rail assembly having two co-planar linear inclined rail members and a second rail assembly having two co-planar linear inclined rail members, the elevated ends of the two rail assemblies meeting at an apical midpoint, wherein the first rail assembly and the second rail assembly are symmetrical and hinged;

a right-handed trolley mounted to the first rail assembly and slidable thereupon; and a left-handed trolley mounted to the second rail assembly and slidable thereupon; wherein each trolley comprises an armrest member sized and configured to engage with a forearm of a human user, the armrest member being rotatable with respect to the trolley and being rotatable around a central longitudinal axis formed by the user's forearm.

* * * * *